United States Patent [19]

Giebeler

[11] Patent Number: 5,026,341

[45] Date of Patent: Jun. 25, 1991

[54] LOW SPEED DISENGAGEABLE DAMPER

[76] Inventor: Robert Giebeler, 21084 Red Fir, Cupertino, Calif. 94014

[21] Appl. No.: 53,452

[22] Filed: May 22, 1987

[51] Int. Cl.[5] ..... B04B 9/14

[52] U.S. Cl. ..... 494/82; 74/574

[58] Field of Search ..... 494/82–84; 74/573, 574; 210/780, 781

[56] References Cited

U.S. PATENT DOCUMENTS

| | | | |
|---|---|---|---|
| 525,468 | 9/1894 | Northrop | 74/574 |
| 770,385 | 9/1904 | Pott et al. | 494/82 X |
| 886,921 | 5/1908 | Bailey | 494/83 X |
| 1,162,125 | 11/1915 | Bassett | 74/574 |
| 1,502,677 | 7/1924 | Law | 74/573 |
| 1,765,477 | 6/1930 | Ackerman | 74/574 |
| 1,776,144 | 9/1930 | Brush | 74/574 |
| 1,886,246 | 11/1932 | Bocz | 74/574 |
| 1,928,763 | 10/1933 | Rosenberg | 74/574 |
| 1,934,597 | 11/1933 | Foppl | 74/574 |
| 1,970,377 | 8/1934 | Heisler | 74/574 |
| 2,129,992 | 9/1938 | DeMattia | 494/82 X |
| 2,524,678 | 10/1950 | Olcott | 210/146 |
| 2,951,731 | 9/1960 | Rushing | 494/82 X |
| 2,961,277 | 11/1960 | Sternlicht | 384/99 |
| 3,135,689 | 6/1964 | Antinori | 494/83 X |
| 3,306,681 | 2/1967 | Barringer | 494/82 X |
| 3,322,338 | 5/1967 | Stallman et al. | 494/82 X |
| 3,430,852 | 3/1969 | Lenkey et al. | 494/82 X |
| 3,770,191 | 11/1973 | Blum | 494/83 X |
| 3,786,694 | 1/1974 | Willeitner | 74/573 |
| 3,902,659 | 9/1975 | Brinkmann et al. | 74/573 X |
| 3,958,753 | 5/1976 | Durland et al. | 494/82 X |
| 4,023,438 | 5/1977 | Birkle et al. | 74/574 |
| 4,205,779 | 6/1980 | Jacobson | 494/82 X |

FOREIGN PATENT DOCUMENTS

| | | | |
|---|---|---|---|
| 643097 | 6/1962 | Canada | 74/574 |
| 203966 | 6/1959 | Fed. Rep. of Germany | 494/84 |
| 2744051 | 4/1979 | Fed. Rep. of Germany | 74/574 |
| 3314503 | 10/1984 | Fed. Rep. of Germany | 74/574 |
| 22529 | 6/1948 | Finland | 494/82 |
| 848674 | 11/1939 | France | 494/82 |
| 2359327 | 2/1978 | France . | |
| 337127 | 4/1959 | Switzerland | 494/82 |
| 543430 | 1/1977 | U.S.S.R. | 494/82 |
| 492433 | 9/1938 | United Kingdom | 74/574 X |
| 820042 | 9/1959 | United Kingdom | 74/574 |
| 1210038 | 10/1970 | United Kingdom . | |

*Primary Examiner*—Harvey C. Hornsby
*Assistant Examiner*—Stephen F. Gerrity

[57] ABSTRACT

In a damper for a centrifuge for damping the rotor of the centrifuge when the rotor changes rotational velocity through a critical vibrational rotation speed, an improved vibration damper is disclosed. The damper is of the type wherein a conically shaped shaft extension is thrust into engagement with a friction bushing at a circular and central opening to increase shaft section and shift the critical vibrational rotation speed away from the particular critical vibrational rotation speed being traversed. The conical bushing is engaged by a solenoid and translates side-to-side rotor motion to an energy dissipating up and down motion at the solenoid. The improvement disclosed is a conically shaped cone having a negative radius of curvature in section. For small shaft side-to-side excursion (due to small vibration) this conically shaped cone has an initial small slope with respect to the bushing to provide reduced damping of the rotor when small vibration and hence small displacements effect the rotor. For large shaft side-to-side excursion, this same conically shaped cone has a large slope with respect to the low friction bushing which provides for increased displacement of the bushing at large displacements of the rotor. Discontinuities of damping are eliminated. Shaft damping at small excursion is damped with corresponding small damping forces. Shaft damping at large excursion is damped with larger force. Transition of damping between the two extremes is provided with an exponentially increasing damping force having no discontinuities. There results a centrifuge damper that can decelerate a classified sample without appreciable declassification of the sample due to vibration induced diffusion.

3 Claims, 3 Drawing Sheets

LOW SPEED DISENGAGEABLE DAMPER

BACKGROUND OF THE INVENTION

This invention relates to centrifuges. Specifically, this invention relates to dampers for centrifuges to enable rotor acceleration and especially rotor deceleration without vibration to eliminate vibration induced diffusion of classified samples.

SUMMARY OF THE PRIOR ART

Dampers for centrifuges are known. For a summary of the reason why such dampers are required, the reader is invited to read U.S. patent application Ser. No. 733,162, filed May 13, 1985 entitled Centrifuge Stabilizing Bearing, now abandoned, in which I am named as a coinventor.

Simply stated, in the above-entitled patent application it is disclosed to shift the critical rotational speed of a centrifuge rotor disposed on a thin shaft as the speed of the rotor approaches a critical vibrational speed. This shifting may be best understood by first outlining the structure of the previous disclosure. Secondly, the shift in the critical vibrational speed will be discussed. Finally, an explanation of how energy induced by vibration is dissipated will be given. This will summarize this most relevant prior art.

Regarding this prior art, the rotor shaft is provided with a conical concentric bearing surface. This conical surface has its apex end exposed downwardly with its truncated base exposed upwardly. This bearing surface moves into and out of engagement with a low friction bushing. The low friction bushing has a circular central opening.

The bushing is attached to a solenoid. As the rotor approaches a critical vibrational speed, the solenoid is energized. When the solenoid is energized, the bushing enters into engagement with the apex end of conical surface on the shaft. Two effects follow. These effects are the shifting of the critical vibrational rotational speed (hereinafter critical speed) and the dissipation of energy.

By utilizing the stabilizing bushing for engagement with the conical portion of the shaft at its critical speed, the critical speed of the shaft rotor and motor is raised. Therefore vibration will be minimized as the rotor passes through that speed range which had formerly been its "critical speed." Once however, the speed of the shaft has transcended this natural critical speed, the removal of the bushing from contact with the cone occurs. This will result in the lowering of the critical speed. However, the rotor will have transcended this critical speed. Again, vibration will be minimized.

The reader will understand that such minimizing of vibration is particularly important upon deceleration. Classically samples are first refrigerated to precise rotor temperatures. Thereafter, they are rotationally classified for long periods of time, for example, 24 hours. When the classified sample is decelerated, it passes out of the high gravity field which caused its classification and maintains its classification. Vibration upon deceleration will cause vibration induced diffusion; the sample will lose its classified characteristics.

The above type of prior art bearing also has the advantage of dissipating energy of rotor translation. Specifically the conical shaped shaft extension bears against the bushing. Upon side-to-side movement of the shaft up and down movement of the bushing occurs. This up and down movement of the bushing opposes the solenoid field as well as produces rubbing of the moving solenoid against a containment cylinder. This up and down movement dissipates the energy of displacement. The rotor is damped.

By way of example, in a so-called "ultra centrifuge" where rotor speeds in the range of 100,000 rpms are utilized, numerous critical vibrational rotation speeds or "criticals" can be present. A so-called first system critical is present at 500 revolutions/minute and constitutes the most serious threat to rotor vibration and hence vibration induced diffusion of the classified sample. Other criticals are present. For example, the drive motor has a critical in the range of 5,000 rpm. Moreover, different shafts have different critical vibration speeds. In the embodiment herein illustrated the damper described only operates around and below the first critical.

STATEMENT OF THE PROBLEM

It has been found that the Centrifuge Stabilizing Bearing described in U.S. patent application Ser. No. 733.162, filed May 13, 1985, imparts damping to transcend the critical frequencies as described. However, the imparted damping induced small vibrations, particularly where a critical was being approached and often in the vicinity of a so-called harmonic of the critical speed.

Further, and with respect to larger vibrations, large rotor displacement resulted in proportionally decreasing rotor restoring force. This force decreased to and until the limits of the damper were reached.

When the limits of the damper were reached, the shaft contributed its own spring biased restoring force. The result of this spring biased restoring force is to produce a large discontinuity. This discontinuity contributes to further vibration and is generally destabilizing of classified samples.

In short, the damper of the Centrifuge Stabilizing Bearing improves the dampening of vibrations, but it is not now the optimum solution. Consequently, this application discloses an improved stabilizing bearing for optimizing stabilization.

It will be understood that the discovery of a problem can constitute invention. Accordingly it will be understood that the identification of the aforementioned discontinuities together with the solution proposed here constitute an important part of the invention herein.

SUMMARY OF THE INVENTION

In a damper for a centrifuge for damping the rotor of the centrifuge when the rotor changes rotational velocity through a critical vibrational rotation speed, an improved vibration damper is disclosed. The damper is of the type wherein a conically shaped shaft extension is thrust into engagement with a friction bushing at a circular and central opening to increase shaft section and shift the critical vibrational rotation speed away from the particular critical vibrational rotation speed being traversed. The conical bushing is engaged by a solenoid and translates side-to-side rotor motion to an energy dissipating up and down motion at the solenoid. The improvement disclosed is a conically shaped cone having a negative radius of curvature in section. For small shaft side-to-side excursion (due to small vibration) this conically shaped cone has an initial small slope with respect to the bushing to provide reduced damping of the rotor when small vibration and hence small displacements effect the rotor. For large shaft side-to-side excursion this same conically shaped cone has a large slope with respect to the low friction bushing which provides for increased displacement of the bushing at large displacements of the rotor. Discontinuities of damping are eliminated. Shaft damping at small excursion is damped with corresponding small damping forces. Shaft damping at large excursion is damped with larger force. Transition of damping between the two extremes is provided with an exponentially increasing damping force having no discontinuities. There results a centrifuge damper that can decelerate a classified sample without appreciable declassification of the sample due to vibration induced diffusion.

OBJECTS AND ADVANTAGES

An object of this invention is to provide exponentially increasing damping with increasing centrifuge rotor excursion. According to this aspect, a bushing having a circular central opening is confronted as a low friction bearing to a cone having a negative curvature. On small shaft excursion, small damping force is provided. On large shaft excursion larger and exponentially increasing damping is provided.

An advantage of the disclosed bushing is that when a rotor transcends a speed range where small vibration may be expected (for example the "harmonic" of a "critical") a smooth transition occurs. Small vibration is not induced.

Yet another object of this invention is to disclose a continuum of damping for all magnitudes of anticipated rotor excursion which is without discontinuities. According to this aspect, when the shaft increases in vibrational excursion, the applied damping force exponentially increases. This increase of damping force asymptomatically approaches the spring constant of the shaft at large excursion. Consequently, the range of damping forces provided are without discontinuity.

An advantage of this aspect of the invention is that the damper itself does not have a tendency to induce vibration in the decelerating rotor.

BRIEF DESCRIPTION OF THE DRAWINGS

Other objects, features and advantages of this invention will become more apparent after referring to the following specification and attached drawings in which:

Referring to FIG. 1 a centrifuge 10 is partially shown. The centrifuge has a drive spindle assembly 12 with a hub assembly 14 which projects into a rotor chamber 16. The drive spindle 18 extends downwardly from the hub assembly 14 for connection with an induction motor assembly 20. Located in the induction motor is an armature shaft 22 which engages an upper high speed bearing 24 and a lower high speed bearing 26. The induction motor 20 has a housing 30 which is mounted below a drive mount plate 32. Both the drive mount plate 32 and the induction motor housing 30 are located below the bottom of the rotor chamber 16.

Figure 1:
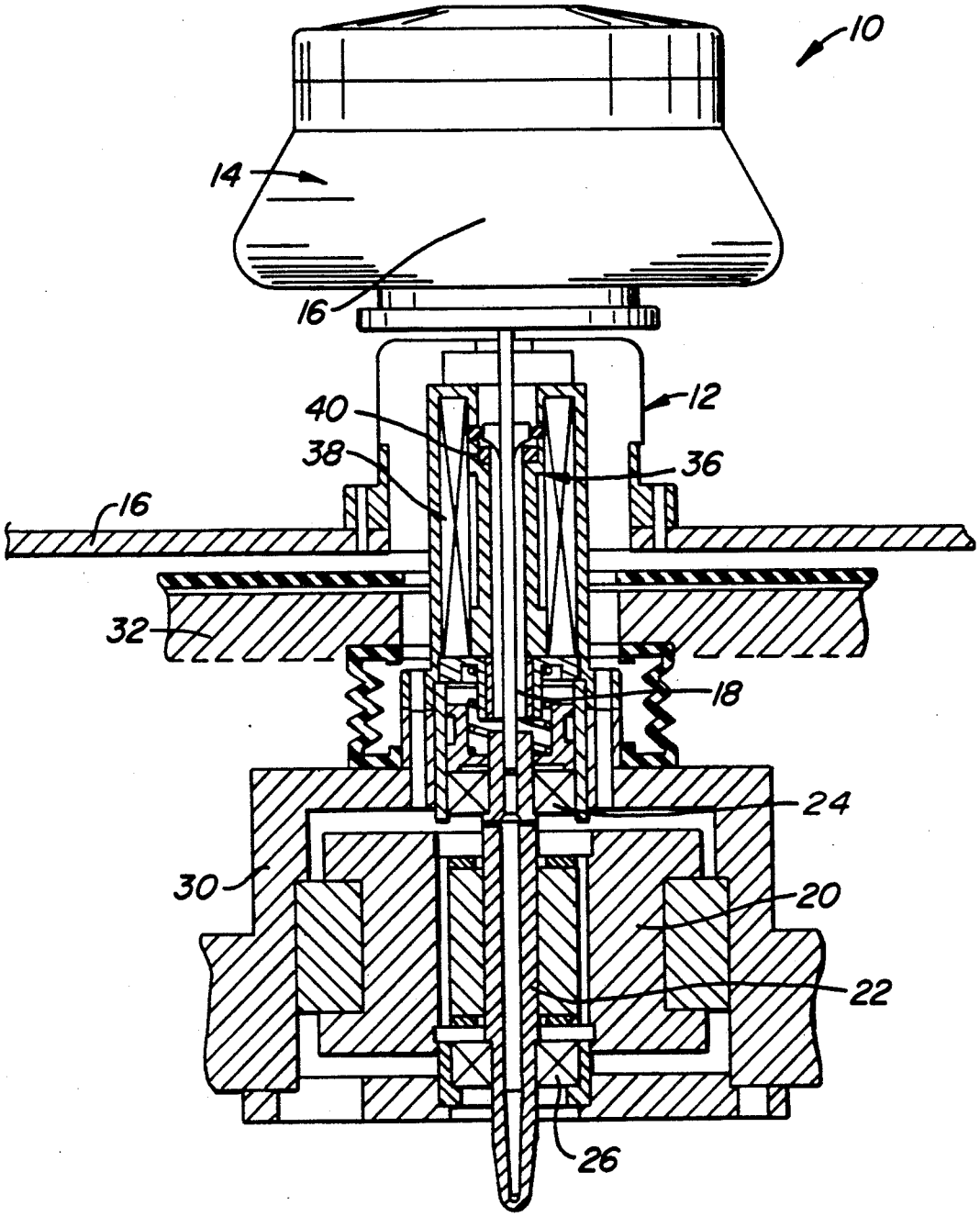
FIG. 1 is a side elevation section of a centrifuge rotor only illustrating the location of the damping apparatus according to this invention.

The shaft 18 in the present invention is preferably a very small diameter drive shaft which is for some centrifuge assemblies as small as approximately 0.187 inches. This shaft is used to drive a relatively small diameter ultracentrifuge rotor, these rotors approaching in diameter 3 inches.

Consequently, the drive shaft 18 is susceptible to flexing due to its function as a coupling between the rotor and the bearings 24, 26. Also the shaft may be subject to flexing caused by rotor imbalance and geometric limitations in the manufacturing methods of the centrifuge. For example, samples placed within the rotor may inevitably induce imbalance in the rotor.

Located above the induction motor 20 and above the upper high speed bearing 24 is the stabilizing bearing assembly 36 of this invention. This stabilizing bearing assembly 36 includes a solenoid coil 38 and a bushing 40. It is this assembly that produces the stabilizing movement required.

Figure 2:
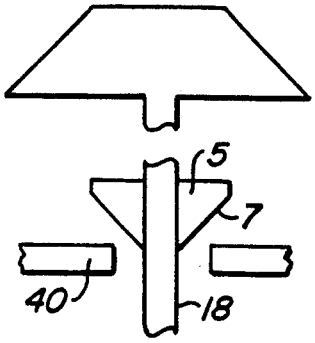
FIG. 2. PRIOR ART
FIG. 2 is a schematic of a prior art damper known.

Referring to FIG. 2, the prior art damper is illustrated. Drive shaft 18 is shown with a conical damper 5. Damper 5 has linear sloping side walls 7. These side walls 7 are forced into contact with bushing 40 by a solenoid similar to that shown in FIG. 3A.

Figure 4:
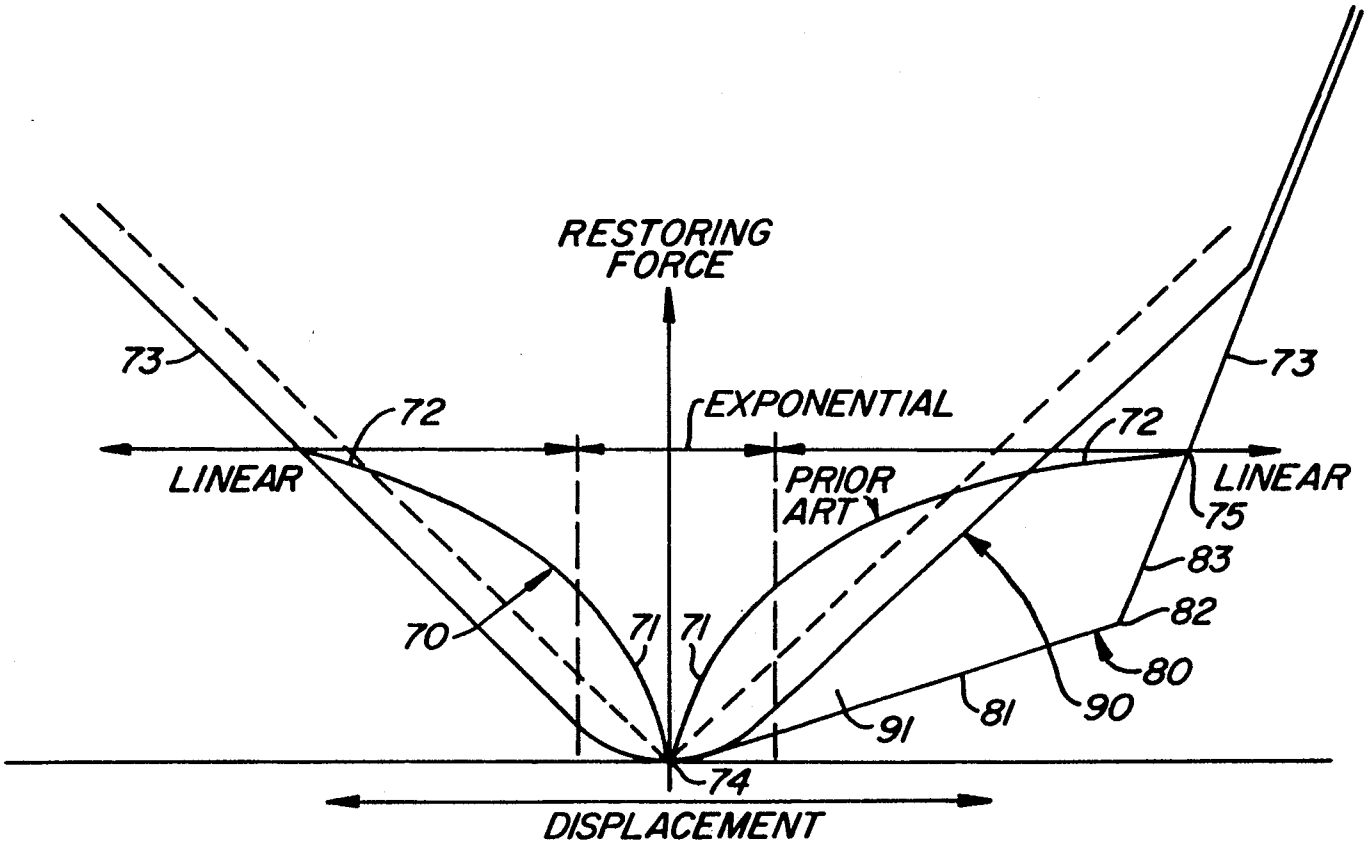
FIG. 4 is a plot of rotor displacement versus rotor restoring force illustrating performance of the prior art apparatus of FIG. 2 with respect to the performance of the improved bearing of FIGS. 3A and 3B.

Referring to FIG. 4, the damping force of such a bearing is illustrated at curve 70.

Specifically and for small excursion, the damping force is relatively large as illustrated at 70. As the excursion of shaft 18 relative to bushing 40 increases the rate of change of the provided damping force decreases. This can be seen at the prior art curve in FIG. 4 at 72.

Finally, when the shaft makes contact with the bushing 40, the spring constant of the shaft of necessity provides the damping force. This can be seen at area 73 of the prior art curve of FIG. 4.

Referring to the prior art curve, the discontinuities are apparent. Specifically a first discontinuity is present with initial displacement. See 74. Secondly, a further discontinuity is present when the bushing contacts the shaft. See 75.

It has been found that these damping discontinuities contribute to shaft vibration. This contribution occurs at two places. The first of these occurrences is upon the encountering of small vibration. Such small vibration can occur either at a so-called "critical" or at an harmonic of the critical. That is to say, it is known that "critical" vibrations also have resident around them small "harmonics". These harmonics constitute small vibrational nodes on either side of a critical. A rotor spinning at a speed that is coincident with a harmonic will undergo small vibration. When the rotor spins at a speed that is coincident with the so-called "critical," much larger vibration occurs.

It has been found that the non-linearity at 74 can cause vibration responsive to passage through a "harmonic" of a critical rather than the critical itself.

Likewise, the discontinuity present at 75 can cause vibration. Typically, as the shaft undergoes full excursion and passes outside of the stabilization provided by the conical bearing, the shaft itself comes into contact with the side of the bushing. When the shaft contacts the bushing the spring force of the shaft takes over the damping function. This can be seen commencing at 75 and extending upwardly at 73. Having set forth the function of the prior art, attention can now be directed to the operation of the preferred embodiment of the invention.

DETAILED DESCRIPTION OF THE PREFERRED EMBODIMENT

Figure 3A:
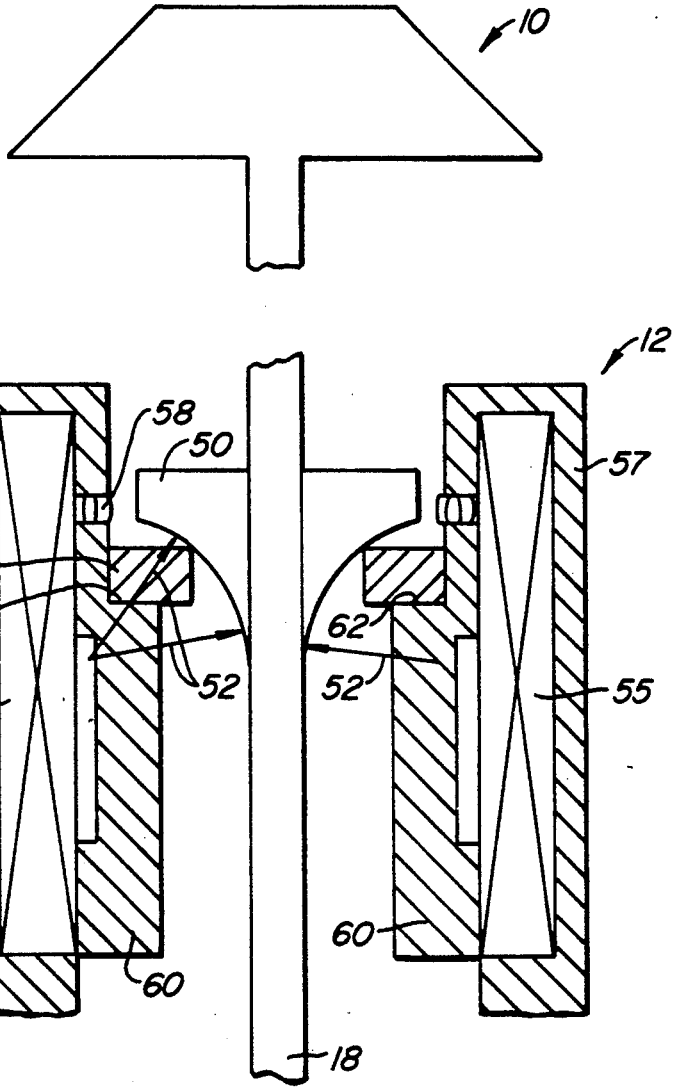
FIG. 3A is a schematic emphasizing the shape of the bearing herein utilized.

Referring to FIG. 3A, the apparatus of this invention is shown enlarged at the point of novelty. Shaft 18 is illustrated with rotor 10 being schematically shown. Shaft 18 has integrally attached thereto a conical extension 50.

Figure 3B:
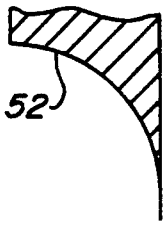
FIG. 3B is a partial view of the negative conical surface attached to the shaft.

Referring to the enlarged section of the cone at FIG. 3B, it will be seen that conical extension 50 includes a radius of curvature 52 in section. The apex and downward end of the conical member 50 has a large slope with respect to bushing 40 in the range of 5° to 15° from the vertical. The base and upward end of the conical member 50 has a small slope with respect to the bushing 40 in the range of 5° to 15° from the horizontal. The resultant radius of curvature between the lower apex end of the conical section and the upper base end of the conical section is responsible for the improved damping characteristics herein.

Referring back to FIG. 3A, a solenoid 55 is surrounded by a ferro magnetic core 57. Core 57 through a gap 58 exerts an attractive force on a magnetic cylindrical member 60. Magnetic cylindrical member 60 at step 62 forces bushing 40 into contact with the curved side walls of the conical member 50.

Operation can now be set forth.

Specifically, when bushing 40 is urged into contact with conical member 50, damping occurs. Damping may be best understood by referring to FIG. 4 and the graphical representation set forth.

It is common that as such rotors approach a so-called "critical," small or minute vibration of the rotor occurs. Such small vibrations may be due to so called "harmonics" of a "critical"; it will be appreciated that the precise understanding of vibrations constitute a most difficult science and art.

Assuming such small vibration, when solenoid 55 is energized an exponential damping force is provided by first engagement of the conical surface 50 with bushing 40. Specifically, the portion of the conical member 50 having a small slope with respect to bushing 40 engages the bushing's central cylindrical member. A damping force is provided. This force is shown in the graph of FIG. 4 at area 70.

Thereafter, and if the vibration becomes more aggravated, the damping provided by the disclosed apparatus is linearized. As the vibration becomes enlarged, and the side-to-side movement of the rotor and shaft become enlarged, engagement of conical member 50 at bushing 40 in an area of large slope occurs. This area of large slope is adjacent the apex of the conical member 50. Specific damping under those portions of the curve labeled 75 reacts largely as a linear function.

The overall effect of the improved damper can be seen with respect to FIG. 4. Specifically, the plot of a prior art damper as set forth in my co-pending application Ser. No. 733,162, filed May 13, 1985, is shown at 70. A plot of an undamped shaft is illustrated at 80. A plot of the damping characteristics of a rotor with the improved damper including the tapered surface of this invention is shown at 90.

Referring again to FIG. 4, the performance of an undamped shaft is illustrated at 80.

Taking the displacement of an undamped shaft under vibration, the natural spring action of the shaft will cause a spring damping along segment 81 of curve 80. This spring damping will occur until such time as the shaft comes in contact with the bushing, this being shown at point 82.

Thereafter, the shaft in contacting the bushing will have a second and stiffer spring force at 83. It will be seen that this spring force is co-linear with spring force 73 of the prior art bushing illustrated.

Having explained the undamped shaft vibration, attention can now be directed to the improved damping provided by the cone of this invention. Referring to curve 90, it will be seen that the resulting damping force is vastly improved. Specifically, the curve 90 contains substantially no discontinuities. The curve asymptotically departs from segment 81 at curve portion 91.

Moreover, it asymptotically approaches the stiff spring constant 83 of the shaft at portion 93. Therebetween the damping force gradually increases as the displacement increases.

It has been found that the damping characteristic herein illustrated is not subject to enhanced vibration when passing either through the criticals or alternating the harmonics of criticals.

What is claimed is:

1. In a damper for a shaft driven centrifuge changing rotational velocity through critical vibrational rotation speeds wherein said damper includes a conically shaped shaft extension; a bushing; means for thrusting said bushing into engagement with said conically shaped shaft extension whereby side-to-side translation of said conically shaped shaft extension translates to up and down movement of said bushing, the improvement to said conically shaped shaft extension including a radius of curvature to provide initial low slope between said conical shaft extension and bushing at small vibration and high slope between said conical shape shaft extension and bushing at large vibration.

2. The invention of claim 1 and wherein said radius of curvature changes continuously between said low slope and said large slope to provide continuously increasing damping on increasing excursion of said shaft.

3. A damper for a shaft driven centrifuge changing rotational velocity through critical vibrational rotation speeds,. said damper including a conically shaped shaft extension fastened to said shaft; a bushing adjacent said shaft at said conically shaped shaft extension; said conically shaped shaft extension including a negative radius of curvature to provide initial low slope between said conical shaft extension and bushing at small excursion of said shaft and high slope between said conical shaft extension and bushing at large excursion of said shaft; means for thrusting said bushing into engagement with said conically shaped shaft extension having said negative radius of curvature whereby side-to-side translation of said conically shaped shaft extension translates to up and down movement of said bushing.

* * * * *